United States Patent [19]

Weymuth

[11] Patent Number: 5,040,801

[45] Date of Patent: Aug. 20, 1991

[54] WASHERS GAME

[76] Inventor: Donald Weymuth, 1101 NE. 115th St., Kansas City, Mo. 64155

[21] Appl. No.: 615,127

[22] Filed: Nov. 19, 1990

[51] Int. Cl.[5] ..... A63B 67/06

[52] U.S. Cl. ..... 273/338; 273/400

[58] Field of Search ..... 273/400, 336, 338

[56] References Cited

U.S. PATENT DOCUMENTS

| | | | |
|---|---|---|---|
| 1,230,503 | 6/1917 | Miller | 273/336 |
| 1,523,756 | 1/1925 | Collins | 273/338 |
| 2,126,245 | 9/1938 | Darby | 273/400 X |
| 3,363,899 | 1/1968 | Gross | 273/412 |
| 3,403,907 | 10/1968 | Keller | 273/350 |
| 3,731,930 | 5/1973 | Jeandron | 273/395 |
| 3,815,915 | 6/1974 | Chapman | 273/338 |
| 3,870,301 | 3/1975 | Brisendine | 273/34 B |
| 4,204,682 | 5/1980 | Brown | 273/401 |
| 4,498,675 | 2/1985 | Jones | 273/338 |
| 4,877,256 | 10/1989 | Falloon | 273/400 |
| 4,982,966 | 1/1991 | Teafatiller | 273/338 |

*Primary Examiner*—William H. Grieb

*Attorney, Agent, or Firm*—Litman, McMahon & Brown

[57] ABSTRACT

An apparatus and method of playing a lawn game uses washer-shaped projectiles which are tossed by players towards target receptacles placed on the ground. The target receptacles are held in place by a nail or spike driven into the ground and each include two or more cups attached together, the cups being of different diameters for presenting different degrees of difficulty. The cups may also be of different heights so that the taller cup can act as a "backboard" for deflecting a tossed washer into the shorter cup, or, depending upon the orientation of the target receptacle, the taller cup can partially shield the shorter cup and, thereby, increase the difficulty of hitting the shorter cup. Each of the cups has a plurality of raised nodes on the bottom thereof to support a washer tossed therein and to act as an aid in removal of the washer by spacing the washer from the bottom of the cup. The nodes permit the player to insert a finger through the bore in the washer and easily remove the washer from the cup. The varying sizes of the cups make the game more versatile, since they can be given different scoring values commensurate with the degree of difficulty, or the rules can be modified to permit players of differing skill levels to compete fairly with each other by assigning different cups as targets to different players.

7 Claims, 1 Drawing Sheet

Fig.1.
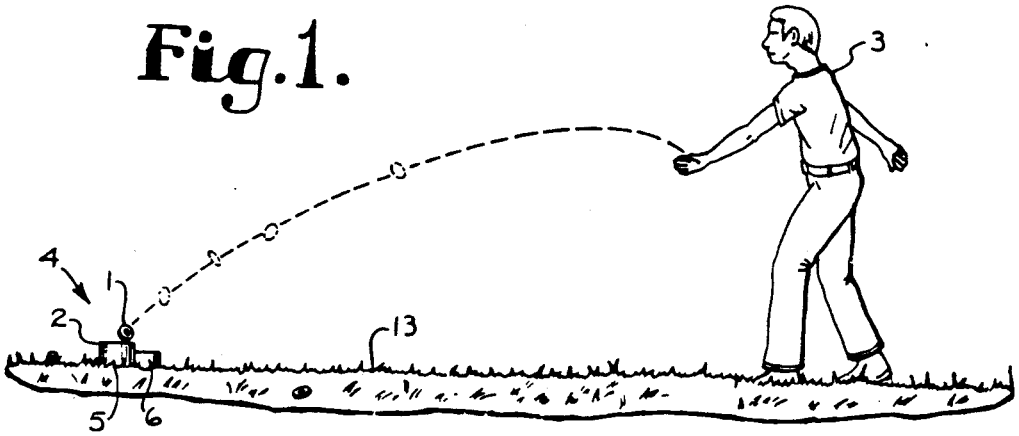
Fig.3.
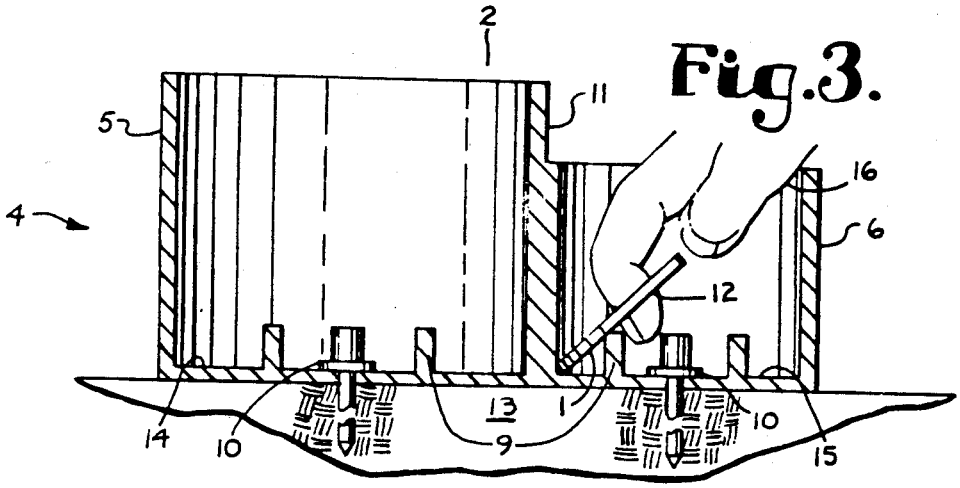
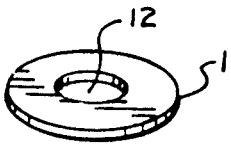
Fig.4.
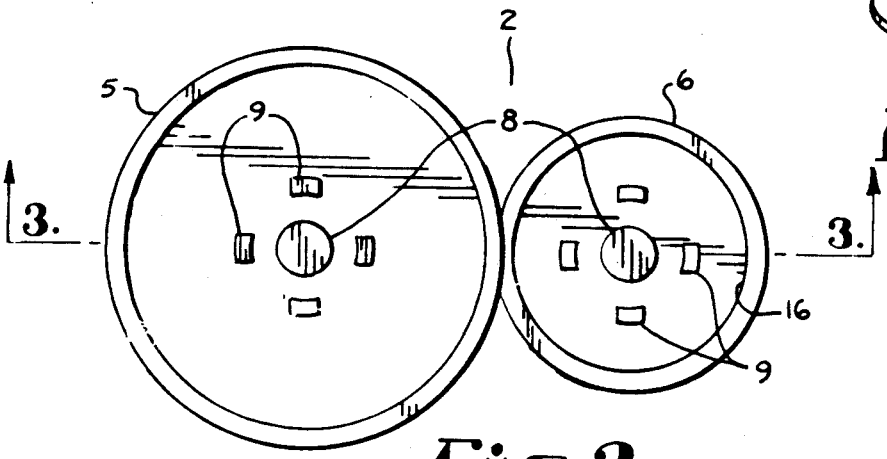
Fig.2.

WASHERS GAME

BACKGROUND OF THE INVENTION

This invention generally relates to a lawn game where players toss projectiles towards target receptacles placed on the lawn. The projectiles are in the shape of washers and the target receptacles include round cups shaped to receive the washers.

Numerous types of lawn games have been developed in the prior art. Many of these games are, in some fashion, a variation on the ancient game of horseshoes. In horseshoes, of course, a projectile in the shape of a horseshoe is directed to a stake placed in the ground some distance from the tosser. Points are accumulated based upon whether the horseshoe-shaped projectile rings the stake or lands within a prescribed distance from the stake. One variation on this theme uses darts which are tossed towards a ring placed on the ground, with the object being to land the dart point-down in the ground inside the ring. Still other variations include rings which are tossed towards a stake with the object being to place the ring around the stake. Other similar games employ balls which are tossed with the objective of landing near a target with points scored according to the proximity to the target. None of these games provide any type of "handicapping" ability so that players of varying degrees of skill can compete with each other on an equal footing.

Consequently, the need exists for a projectile toss game which uses multiple targets which require varying degrees of skill so that players of differing abilities can compete fairly.

SUMMARY OF THE INVENTION

The present invention provides an apparatus and a method for playing a lawn game where relatively flat, annularly or ring-shaped washers are tossed toward a target placed on the ground at a specific distance from the players. The target is formed of a receptacle having a plurality of circular, cup-like receivers or cups of different sizes attached together. The cups are held rigidly in place by a plurality of spikes, normally with one spike per cup, which are inserted through apertures in the center of the bottom of each cup and driven into the ground.

The cups are preferably of different sizes and different heights. This allows the taller of the cups to be used as a "backboard" for the shorter cup(s) so the tossed washers may be bounced off one or more of the taller cups into the shorter cup(s). Alternatively, the cups may be oriented such that the taller cup partially hides the shorter cup(s) and acts as a barrier, making it more difficult to toss a washer into the shorter cup(s).

The cups are preferably formed of molded plastic and each circular cup has a plurality of protuberances or nodes formed on the bottom to support a washer tossed therein in spaced relationship relative to the bottom of the cup so as to allow a player to manipulate the player's fingers beneath a washer in the cup and thereby facilitate removal of such a washer from the cup.

The washers are also preferably formed of molded plastic and can be of varying sizes as well to provide an additional "handicapping" system. The washers are constructed so that the bore in the center of each washer permits a player to easily insert a finger and remove it from the cups. Therefore, the washer bores are not proportional to the size of the washer, but rather, all sizes of washers have bores shaped to receive the player's finger.

OBJECTS AND ADVANTAGES OF THE INVENTION

Therefore, the objects of the invention are: to provide a lawn game where players toss washer-shaped projectiles at a target placed on the ground; to provide such a game where the target is a receptacle having multiple circular cups of varying sizes to permit players of different skill levels to compete fairly; to provide such a game where the cups are also of different heights so that the taller cup can alternatively be used as a "backboard" for the shorter cup(s), or as a partial shield therefor; to provide such a game where raised projections or nodes are formed on the bottom of the cups to facilitate removal of washers therefrom; to provide such a game where spikes are inserted through apertures in the bottoms of the cups and into the ground to hold the receptacle in place; to provide such a game which is challenging but simple; to provide such a game which is versatile and will tend to keep the interest of players over a long period of time; and to provide such a game that is relatively easy to construct, inexpensive and particularly well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a side elevational view of a game apparatus according to the present invention, shown with a player and depicting the play of a game associated with the game apparatus.

FIG. 2 is an enlarged, partial top elevational view of the apparatus showing multiple cups comprising a target receptacle thereof.

FIG. 3 is an enlarged, cross-sectional view of the game apparatus, taken along line 3—3 of FIG. 2 and illustrating a player removing a projectile washer from one of the cups.

FIG. 4 is an enlarged perspective view of one of the projectiles of the game apparatus.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, FIG. 1 shows a player in the process of playing a game. In the game, a ring-shaped or annular projectile, preferably shaped like a washer 1, is tossed towards a target receptacle 2 placed on a surface at some distance from the player 3. The receptacle 2 comprises a pair of cups 5 and 6. The washer 1 and receptacle 2 together form an apparatus 4 according to the present invention for playing the game. The object of the game is for the player to toss the washer 1 such that the washer 1 lands inside one of the cups 5 and 6. The target receptacle 2 is best illustrated in FIGS. 2 and 3. FIG. 2 shows a top elevational view of cups 5 and 6, more of which can be utilized in certain embodiments of the game. As shown in FIG. 2, cup 5 is of a larger diameter than cup 6. Thus, cup 5 provides an easier target for the player to hit than does cup 6. This difference can be utilized in different ways. One variation, where the competing players are of fairly equal ability, would be to place a greater scoring value on the washer 1 landing in cup 6 as compared to landing in cup 5. Another variation, which permits players of different skill levels to compete fairly, is to assign the smaller target to the player of greater skill, and the larger target to the player of lesser skill.

FIGS. 2 and 3 also illustrate some of the construction details of the target receptacle 2. Target receptacle 2 is preferably formed of rugged, high-impact resistant, molded plastic which can be of any desired color. Preferably the color of target receptacle 2 and washers 1 will be different and the washers 1 of competing players will be of different colors as well.

One of the washers 1 is best illustrated in FIG. 4. The washers 1 are also preferably formed of high-impact resistant, molded plastic and have a bore 12 in the middle which is sized to readily accommodate the finger of a player to facilitate removal of the washer 1 from the target receptacle cups 5 or 6. Each cup 5 and 6 in the target receptacle 2 has a plurality of nodes 9 formed on the bottom thereof. As illustrated in FIG. 3, these nodes 9 act to support the washer 1 and to provide a space beneath the washer 2 so that the player can insert his finger through the bore 12 in the center of the washer 1 and get a secure grip to easily remove same from the cup 5 or 6.

During the molding process, each cup 5 and 6 in the target receptacle 2 is provided with an aperture 8 in the center of the bottom to accommodate a spike 10, preferably also made of plastic, that is driven through the aperture 8 and into the ground 13 to secure the target receptacle 2 to the ground 13.

As is illustrated in FIG. 3, one of the cups 5 may be made taller than the other cup 6. This results in a vertical wall 11 between the cups 5 and 6 and this adds greater versatility to the game since, when the target receptacle 2 is oriented as shown in FIG. 1 with the taller cup 5 furthest from the player, the wall 11 acts as a backboard so that washers 1 may be bounced off of it and into the smaller cup 6. Bottoms 14 and 15 of the cups 5 and 6 respectively are preferably flat and coplanar to allow the receptacle 2 to rest evenly on a planar surface such as the ground 13. Conversely, if the target receptacle 2 is rotated one hundred eighty degrees, the taller cup 5 acts to partially block the opening 16 of the smaller cup 6, which makes it harder to get the washer 1 into the smaller cup 6.

In practice, the game may be played as follows: at least two players, each provided with a plurality of washers 1, preferably of different colors, stand a specified distance away from the target receptacle 2. The players take turns tossing their washers 1 toward the target receptacle 2 in an effort to get the washers 1 to land and stay in the cups 5 and 6 in the target receptacle. If the players are of equal ability, the cups may be assigned different point values. For example, the larger cup 5 may be assigned a value of one point while the smaller cup 6 is assigned a value of two points for each washer 1 which a player successfully tosses into the cup 5 or 6. If the players are of differing abilities, the player of greater skill may be given little or no credit for tossing the washer 1 in the larger cup 5 and a credit of one point for getting his washer 1 into the smaller cup 6. Conversely, the player of lesser skill will be given a full point for getting his washer 1 in the larger cup 5 and, possibly, two points for getting his washer 1 into the smaller cup 6. If it is desired, two target receptacles 2 may be provided at the proper distance apart so that the players, as in horseshoes, alternate tossing towards the target receptacles 2 to minimize walking during the game.

Many variations in play with the invention will occur to the average player. For example, if no player manages to get a washer 1 to stay in a cup 5 or 6 during one series of tosses, the closest washer 1 to the target receptacle 2 may be awarded a point. Furthermore, a player managing to toss one of his washers 1 into a cup 5 or 6 on top of a washer 1 of another player may act to negate the points of the washer 1 from the other player. Only the top washer 1 would be counted, or possibly all washers 1 of that player in the target receptacle 2 would count and none of the opposing player. Games could be structured such that the first player to reach fifteen or twenty-one or any other desired number would be the winner.

As stated earlier, this game allows players of differing abilities to compete fairly with each other. In addition to requiring the better player to hit the smaller cup 6, the target receptacle 2 could be oriented such that the taller cup 5 is placed closest to the throwers with the better player required to hit the smaller cup 6 which is partially hidden by the taller and larger cup 5. Washers 1 of varying sizes could be used by the players, with the different sizes accorded different point values or being assigned to players of differing abilities. By using one or more variations of these "handicaps", players of widely varying abilities can be relatively evenly matched.

It is foreseen that additional variations in the game, including variations in the target receptacle 2 design and washer 1 design could be used. For example, the smaller cup 6 could be the taller of the two cups 5 and 6 in target receptacle 2. The target receptacle 2 and washer 1 could be made of materials other than molded plastic, such as steel or the like. Projectiles of the shape other than washers 1, such as round balls, for example, could also be used with similar target receptacles 2. The game can also be adapted for indoor play by using washers 1 of soft foam or other resilient material, and by providing suction cups or the like to secure the receptacles 2 to the floor. Variations in playing techniques and scoring are limited only by the players' imagination.

It is to be understood that while certain forms of the present invention have been illustrated and described herein, it is not to be limited to the specific forms or arrangement of parts described and shown.

What is claimed and desired to be secured by Letters Patent is as follows:

1. A game apparatus comprising:

(a) a plurality of projectiles adapted to be tossed by a player of said game; each of said projectiles has a bore through the center thereof for insertion of a finger of said player therethrough;

(b) a target receptacle for accommodating said tossed projectiles; said target receptacle comprising a plurality of cups; each said cup having a different diameter; and (c) a plurality of nodes on a bottom of each said cup; said nodes adapted to space said projectiles tossed therein from respective said bottom to permit easy removal of said projectiles by said insertion of said finger of said player through respective said centerbores.

2. The game apparatus according to claim 1 wherein:

(a) each cup in said target receptacle is of a different height.

3. The game apparatus according to claim 2 wherein:

(a) each of said cups is secured to at least another of said cups; and (b) one of said cups is taller than the remaining cups and a side wall of said taller cup is used as a "backboard" for a shorter cup.

4. The game apparatus according to claim 1 wherein:

(a) said target receptacle includes means for securing said target receptacle to a supporting surface.

5. The game apparatus according to claim 4 wherein:

(a) said means for securing includes at least one spike that is adapted to be driven into the ground through an aperture positioned in the bottom of at least one of said cups.

6. The game apparatus according to claim 1 wherein:

(a) each of said projectiles is shaped like a washer and is formed of colored plastic with different colored projectiles adapted for use by each player.

7. A method of playing a tossing game wherein projectiles are tossed toward a target by players of said game, comprising the steps of:

(a) providing:

(1) a plurality of circularly shaped disks adapted to serve as said projectiles wherein each said disk has a centerbore for inserting a finger of one of said players therethrough; and (2) a target receptacle adapted to serve as said target for said tossed projectiles wherein said target receptacle includes a plurality of cups, each said cup having:

(A) a different height from each of the other said cups;

(B) a different diameter from each of the other said cups; and (C) a plurality of nodes on a bottom thereof wherein said plurality of nodes adapted to space said projectiles tossed therein from said bottom such that said projectiles are easily removed by said player by said inserted finger through said centerbore;

(b) spacing said target receptacle at a prearranged distance from said players;

(c) assigning each of said cups to a different one of said players according to each of said player's skill level, with the player having the greatest skill being assigned to the cup having the smallest diameter; and (d) providing a point scoring relationship for said players to provide a handicapping system which, in conjunction with said cups having different diameters and different heights, allows players of differing skill levels to compete with each other on an equal basis.

* * * * *